US010751913B2

(12) United States Patent
Troitino Lopez et al.

(10) Patent No.: US 10,751,913 B2
(45) Date of Patent: Aug. 25, 2020

(54) MIXER FOR FORMING CERAMIC SUSPENSION WITH REDUCED COOLING AND RELATED METHOD

(71) Applicant: General Electric Company, Schenectady, NY (US)

(72) Inventors: Jose Troitino Lopez, Greenville, SC (US); James Stuart Pratt, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 253 days.

(21) Appl. No.: 15/635,250

(22) Filed: Jun. 28, 2017

(65) Prior Publication Data

US 2019/0001525 A1 Jan. 3, 2019

(51) Int. Cl.

| | |
|---|---|
| ***B28C 1/04*** | (2006.01) |
| ***B01F 3/10*** | (2006.01) |
| ***B01F 7/16*** | (2006.01) |
| ***B01F 9/10*** | (2006.01) |
| ***B01F 13/10*** | (2006.01) |
| ***B28C 1/00*** | (2006.01) |
| ***B01F 9/12*** | (2006.01) |
| ***B01F 11/00*** | (2006.01) |
| ***B28C 5/32*** | (2006.01) |
| ***B28C 1/02*** | (2006.01) |
| ***B28C 5/46*** | (2006.01) |

(Continued)

(52) U.S. Cl.

CPC ..... *B28C 1/04* (2013.01); *B01F 3/10* (2013.01); *B01F 7/16* (2013.01); *B01F 9/106* (2013.01); *B01F 9/12* (2013.01); *B01F 11/0062* (2013.01); *B01F 11/0068* (2013.01); *B01F 13/06* (2013.01); *B01F 13/1025* (2013.01); *B28C 1/003* (2013.01); *B28C 1/02* (2013.01); *B28C 5/32* (2013.01); *B28C 5/464* (2013.01); *B01F 2009/0065* (2013.01)

(58) Field of Classification Search

CPC ..... B28C 1/04; B28C 5/32; B01F 9/08; B01F 9/12; B01F 11/0068; B01F 7/1695

USPC ..... 366/95, 605

See application file for complete search history.

(56) References Cited

U.S. PATENT DOCUMENTS

| | | | | |
|---|---|---|---|---|
| 5,865,538 | A | 2/1999 | Walker et al. | |
| 8,122,815 | B2 * | 2/2012 | Wolfe | A47J 36/165 99/348 |
| 2015/0033982 | A1 | 2/2015 | Bewlay et al. | |

FOREIGN PATENT DOCUMENTS

| | | | |
|---|---|---|---|
| EP | 2386351 | A2 | 11/2011 |

* cited by examiner

*Primary Examiner* — Elizabeth Insler

(74) *Attorney, Agent, or Firm* — James Pemrick; Hoffman Warnick LLC

(57) ABSTRACT

A mixer is disclosed including a sealed mixing chamber having an interior, and a rotating mixing bowl within the interior of the sealed mixing chamber. A stand operatively supports the sealed mixing chamber. The stand includes: a foundation, a mixing chamber base movably coupled to the foundation and positioning the sealed mixing chamber at an angle relative to horizontal, and a linear actuator system configured to move the mixing chamber base relative to the foundation in at least one linear direction. A rotating mixing head is operatively positioned and sealingly disposed within the sealed mixing chamber, the rotating mixing head rotating within the rotating mixing bowl. The mixer and a related method provide for ceramic suspension mixing with reduced cooling and possibly without cooling the suspension.

12 Claims, 3 Drawing Sheets

(51) Int. Cl.

| | |
|---|---|
| ***B01F 13/06*** | (2006.01) |
| *B01F 9/00* | (2006.01) |

MIXER FOR FORMING CERAMIC SUSPENSION WITH REDUCED COOLING AND RELATED METHOD

BACKGROUND OF THE INVENTION

The disclosure relates generally to mixing, and more particularly, to a high volume mixing of a slurry such as a ceramic suspension with reduced cooling of the suspension.

Conventional manufacture of ceramic components includes mixing constituents to form a ceramic suspension during which the temperature of the suspension is carefully controlled to ensure a high quality ceramic and prevent premature curing. In particular, the mixing of ceramic suspension constituents typically creates high temperatures such that a ceramic suspension must be cooled, e.g., to −40° C., during mixing to prevent premature curing and to allow for the necessary intermixing of the constituents. Where high volumes of the ceramic suspension are needed, the process can be very complicated including, for example, pre-chilling the constituents and then repeatedly mixing certain constituents, chilling the suspension, adding additional constituent(s), and re-chilling the suspension, before using the suspension to form the ceramic component. The process is very time consuming because of the need to keep the suspension cool. An additional challenge is attaining a high quality intermixing of constituents as the process proceeds. Current mixers for suspension are rudimentary, providing an overhead mixer to an open-air bowl and using a simple planetary path for the mixing head. Use of such mixers can cause defects by pulling in air into the suspension which creates additional steps to remove the air. Current mixers also present challenges during the above-described mixing process, e.g., keeping the suspension cool and handling the suspension between mixing and chilling steps. Consequently, current mixers do not provide effective mixing with low heat and quick production for high volumes.

BRIEF DESCRIPTION OF THE INVENTION

A first aspect of the disclosure provides a mixer, comprising: a sealed mixing chamber having an interior; a rotating mixing bowl within the interior of the sealed mixing chamber; a stand for operatively supporting the sealed mixing chamber, the stand including: a foundation, a mixing chamber base movably coupled to the foundation and positioning the sealed mixing chamber at an angle relative to horizontal, and a linear actuator system configured to move the mixing chamber base relative to the foundation in at least one linear direction; and a rotating mixing head operatively positioned and sealingly disposed within the sealed mixing chamber, the rotating mixing head rotating within the rotating mixing bowl.

A second aspect of the disclosure provides a method of mixing a ceramic suspension with reduced cooling to the ceramic suspension, the method comprising: adding at least two constituents of the ceramic suspension into a mixing bowl positioned in a mixing chamber, the mixing chamber and the mixing bowl being tilted relative to horizontal; sealing the mixing chamber and applying a vacuum, creating a sealed mixing chamber; and mixing the at least two constituents in the mixing bowl in the sealed mixing chamber with reduced cooling by simultaneously: first rotating a rotating mixing head relative to the mixing bowl, second rotating the mixing bowl, and moving the sealed mixing chamber in at least one linear direction.

A third aspect of the disclosure provides a mixer for mixing a ceramic suspension with reduced cooling the ceramic suspension, the mixer comprising: a sealed mixing chamber having an interior and an exterior; a rotating mixing bowl within the interior of the sealed mixing chamber, the rotating mixing bowl including a first rotational actuator; a stand for operatively supporting the sealed mixing chamber, the stand including: a foundation, a mixing chamber base movably coupled to the foundation by a plurality of elastic mounts, the mixing chamber base positioning the sealed mixing chamber at an angle relative to horizontal, and a linear actuator system to move the mixing chamber base relative to the foundation, the linear actuator system including: a first linear actuator system coupled to the mixing chamber base for moving the sealed mixing chamber in a first linear direction; and a second linear actuator system coupled to the mixing chamber base for moving the sealed mixing chamber in a second linear direction different than the first linear direction; and a rotating mixing head operatively positioned and sealingly disposed within the sealed mixing chamber, the rotating mixing head including a second rotational actuator for rotating the rotating mixing head within the rotating mixing bowl.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Embodiments of the disclosure provide a mixer and a method for mixing materials such as constituents of a ceramic suspension with at least reduced cooling of the suspension. As will be described, the mixer provides at least four motions that collectively act to mix the ceramic suspension with reduced friction and thus at least reduces, and possibly eliminates, the need to cool the ceramic suspension. The ceramic suspension may include any now known or later developed ceramic suspension such as but not limited to those for creating ceramic cores for metal castings of gas turbine blades. While embodiments of the disclosure will be described for applications with ceramic suspension, it is emphasized that the teachings of the disclosure are applicable to any material requiring mixing.

Figure 1:
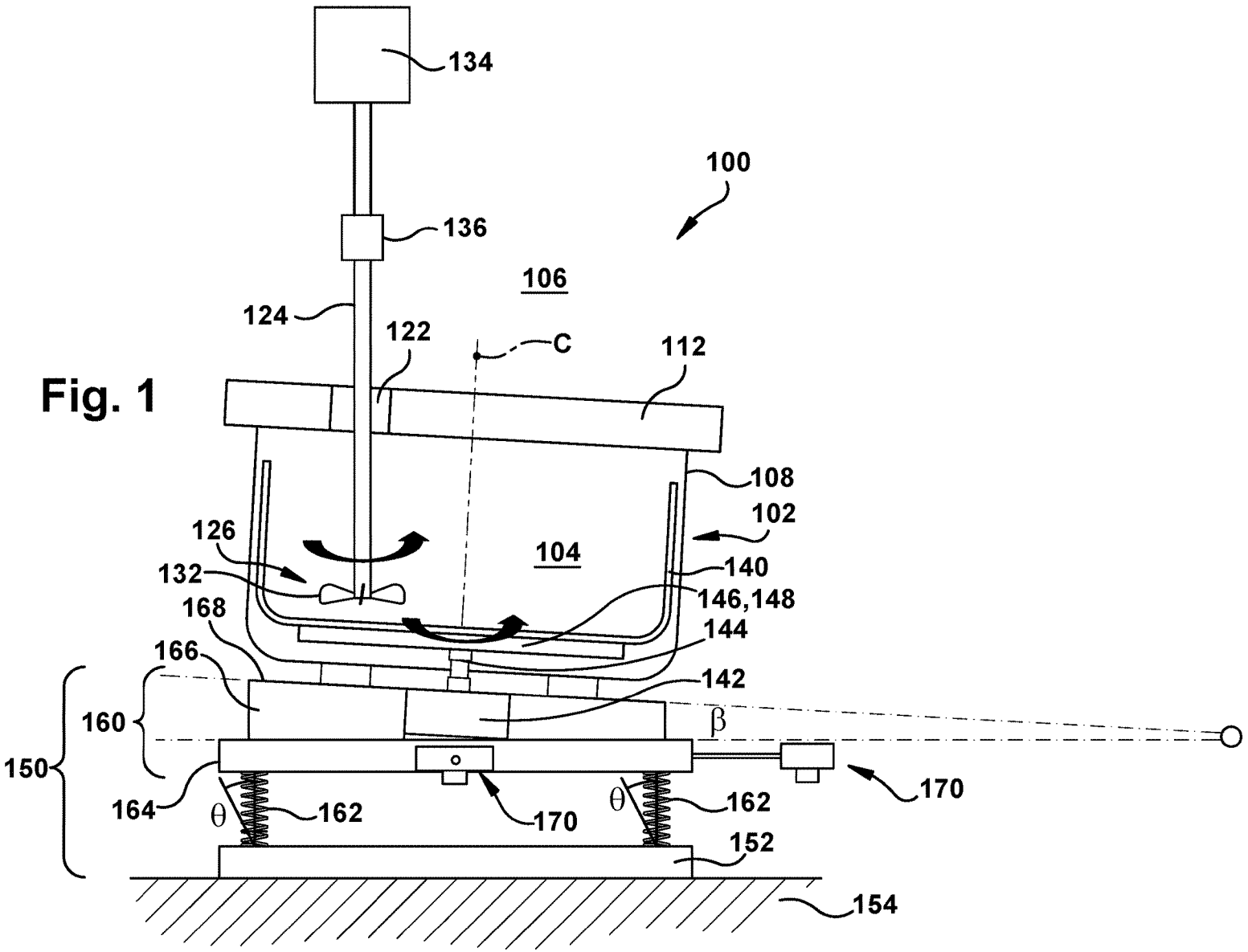
FIG. 1 shows a schematic side view of a mixer according to embodiments of the disclosure.

FIG. 1 shows a schematic side view of a mixer 100 according to embodiments of the disclosure. Mixer 100 may include a sealed mixing chamber 102 having an interior 104 and an exterior 106. As will be described, sealed mixing chamber 102 remains rotationally stationary but can move linearly in a limited fashion during mixing according to embodiments of the disclosure. Sealed mixing chamber 102 may include any industrial strength material of appropriate strength and corrosion resistance to accommodate materials to be mixed therein. Materials may include but are not limited to: stainless steel and aluminum. Sealed mixing chamber 102 may include any form of sealing system 110 appropriate for the materials used. Sealing system 110 may include, for example, a lid 112 configured to seal to a chamber body 108, e.g., via clamping system, a seal-tight polymer, or any other now known or later developed sealing arrangement.

Figure 2:
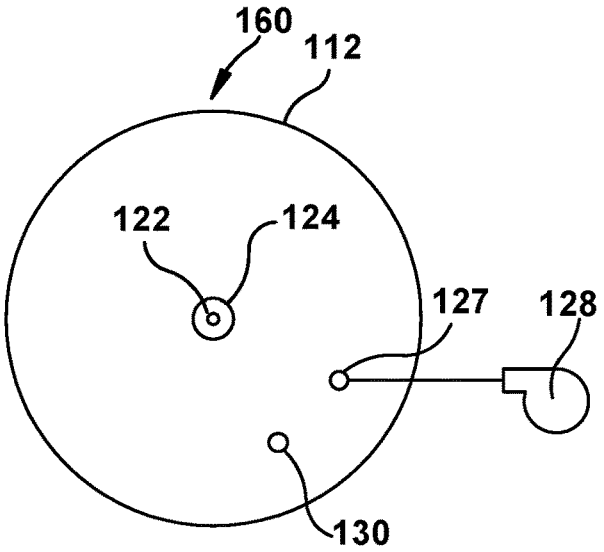
FIG. 2 shows a schematic top view of a sealed mixing chamber according to embodiments of the disclosure.

As shown in the schematic top view of FIG. 2, sealed mixing chamber 102 may include a number of ports for accessing interior 104 thereof without losing the seal therein. In one embodiment, a first port 122 may be provided for sealingly positioning a shaft 124 of a rotating mixing head 126 (FIG. 1) relative to sealed mixing chamber 102 (FIG. 1). First port 122 may include any ferrofluidic seal for allowing rotation of shaft 124 in a sealed manner. Shaft 124 can extend into sealed mixing chamber 102 at any location therein, e.g., centered as shown in FIG. 2 or offset from center C as shown in FIG. 1. Sealed mixing chamber 102 may also include a second port 127 for coupling a vacuum source 128 to interior 104 of sealed mixing chamber 102. Second port 127 may include any form of seal for allowing vacuum source 128 to apply a vacuum to interior 104 (FIG. 1), e.g., a tubular polymer seal, a metal barbed fitting capable of having a vacuum line pressed on or attached thereto. Vacuum source 128 may include any now known or later developed pump, compressor, etc., capable of controllably generating a vacuum within interior 104. Sealed mixing chamber 102 may also include a third port 130 for selectively allowing addition of a constituent (not shown) for mixing in sealed mixing chamber 102. Third port 130 may include any type of selectively openable seal allowing introduction of an additional constituent, e.g., in powder or liquid form, into interior 104. As will be understood, the type of constituent may dictate the type of third port 130 employed, e.g., a valve, a door, etc. Third port 130 is selectively openable and closeable to allow entry of the constituent without losing the seal of sealed mixing chamber 102, and may include any form of valve (not shown) to accommodate such functioning.

Returning to FIG. 1, mixer 100 may also include a rotating mixing head 126 operatively positioned and sealingly disposed within sealed mixing chamber 102, e.g., via first port 122. Rotating mixing head 126 may include any industrial strength material of appropriate strength and corrosion resistance to accommodate materials to be mixed therewith. As will be described, rotating mixing head 126 rotates within a rotating mixing bowl 140. Rotating mixing head 126 is rotatable via a rotational actuator 134. Rotating mixing head 126 includes a set of beaters 132. Beaters 132 may take any form appropriate to mix the constituents desired to be mixed. Rotating mixing head 126 may also include shaft 124 coupled to set of beaters 132 and configured to sealingly extend from interior 104 of sealed mixing chamber 102 to exterior 106 of the sealed mixing chamber, as described previously. Rotating mixing head 126 may also include a rotational actuator 134 positioned in exterior 106 of sealed mixing chamber 102 for rotating shaft 124 and set of beaters 132. Rotational actuator 134 may include any now known or later developed source of rotation such as but not limited to an electric, hydraulic or pneumatic motor or some form of engine. In one optional embodiment, shaft 124 may include an articulated joint 136 in a length thereof. Articulated joint 136 may include any now known or later developed joint such as universal joint allowing angled rotational coupling between different shafts, e.g., an output shaft of rotational actuator 134 and a shaft coupled to set of beaters 132. Articulated joint 136 may not be necessary in all instances.

Mixer 100 may also include a rotating mixing bowl 140 within interior 104 of sealed mixing chamber. Constituents to be mixed are held by rotating mixing bowl 140 within sealed mixing chamber 102. Rotating mixing bowl 140 may include any industrial strength material of appropriate strength and corrosion resistance to accommodate materials to be mixed therein. Materials may include but are not limited to: stainless steel and aluminum. Rotating mixing bowl 140 may also include a rotational actuator 142 positioned in exterior 106 of sealed mixing chamber 102 for rotating mixing bowl 140. Rotational actuator 142 may include any now known or later developed source of rotation such as but not limited to an electric, hydraulic or pneumatic motor or some form of engine. Rotational actuator 142 may extend into sealed mixing chamber 102 using any now known or later developed ferrofluidic seal or seal bearing 144. Rotating mixing bowl 140 may removably couple to rotational actuator 142 within sealed mixing chamber 102 in any fashion. In one example, shown in the perspective view of FIG. 4, rotational actuator 142 may include a connection plate 146 coupled thereto that rotationally mates and locks with a connection plate 148 on a bottom of the mixing bowl, e.g., with flanges 149 seating in locking seats 151. While rotational actuators 134, 142 are illustrated as in exterior 106 of sealed mixing chamber 102, it is understood that they may be located within sealed mixing chamber 102 where necessary sealing compartments are used and the environment therein allows.

Mixer 100 may also include a stand 150 for operatively supporting sealed mixing chamber 102. As will be described, stand 150 includes a number of features that allow for multiple axis rotation and linear movement of sealed mixing chamber 102 that allows for mixing of a ceramic suspension with at least reduced cooling of the suspension.

Figure 3:
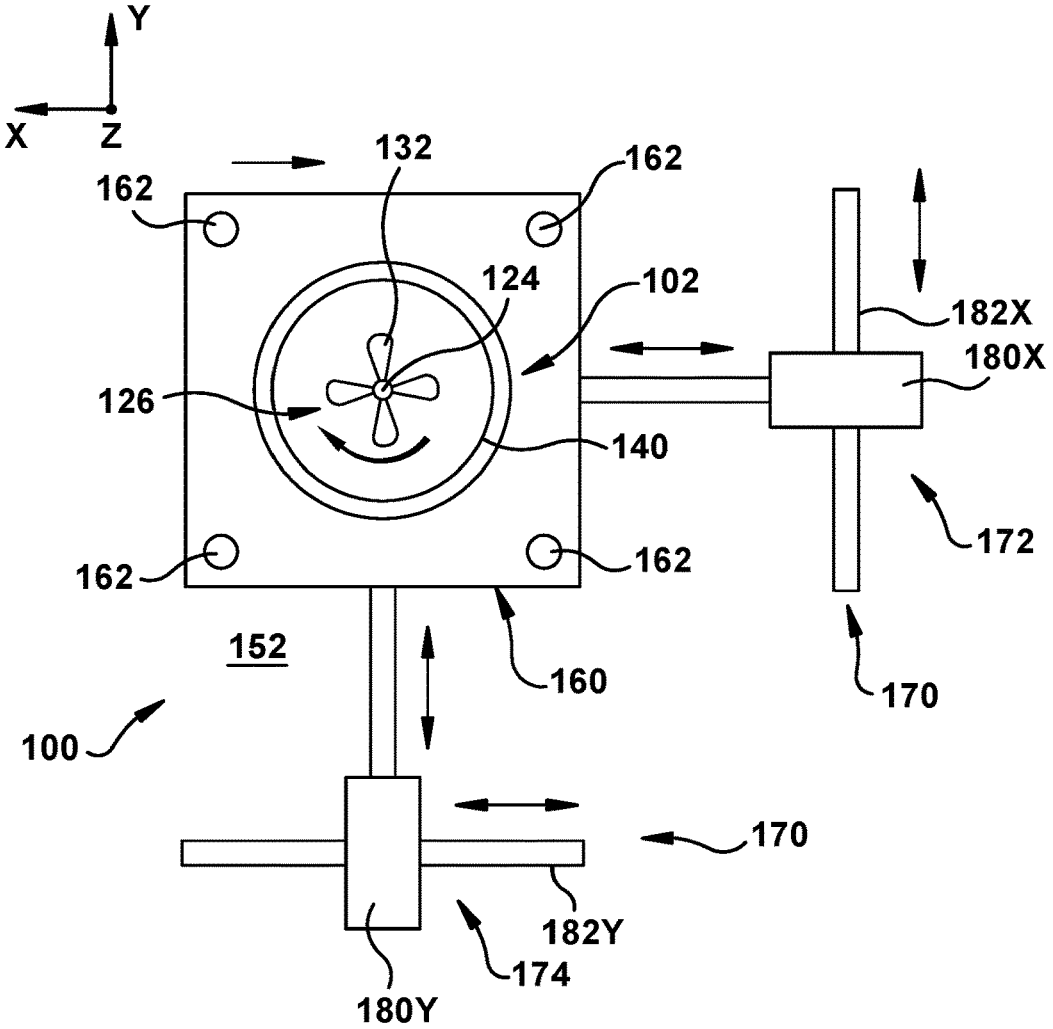
FIG. 3 shows a schematic top view of a mixer according to embodiments of the disclosure.

Stand 150 may include a foundation 152 for supporting sealed mixing chamber 102 relative to a floor or other foundational base 154. Stand 150 may also include a mixing chamber base 160 movably coupled to foundation 152 and positioning sealed mixing chamber 102 at an angle β relative to horizontal. As shown in FIGS. 1 and 3, in one embodiment, a plurality of elastic mounts 162 may couple mixing chamber base 160 to foundation 152. Elastic mounts 162 may include any now known or later developed elastic element capable of flexing to absorb shock and movement in a limited fashion. Elastic mounts 162 may include but are not limited to: springs, polymer blocks, etc. Elastic mounts 162 may be adjustable so as to select the amount of flex therein, e.g., pre-loaded spring assemblies with threaded length/compression adjusters.

In one embodiment, mixing chamber base 160 may include a first member 164 coupled to a second, angling member 166. First member 164 may include a flat plate configured to mount generally horizontally using elastic mounts 162 to foundation 152, while second, angling member 166 may include a plate or block higher at one side than another to provide an angled upper surface 168 upon which sealed mixing chamber 102 can be mounted. Angle β can be any angle sufficient to cause movement of constituents in rotating mixing bowl 140 from one side of rotating mixing bowl 140 to the other to increase mixing thereof. While angle I is shown as a fixed angle, in an alternative embodiment, second, angled member 166 may be adjustably angled relative to horizontal using, for example, any now known or later developed adjustably hinged member. Sealed mixing chamber 102 may be coupled to mixing chamber base 160 using any now known or later developed couplings, e.g., threaded fasteners, etc.

Rotational actuator 142 for rotating mixing bowl 140 may be positioned within second, angled member 166, but this is not necessary in all cases. In one embodiment, rotational actuator 134 of rotating mixing head 126 and rotational actuator 142 cause rotation in opposite directions. In this fashion, improved mixing compared to just use of rotating mixing head 126 is observed. The use of angle β also adds to the improved mixing as it causes the suspension to move towards one side of rotating mixing bowl 140 and intersect rotating mixing head 126 more frequently than if chamber 102 was horizontal.

Figure 4:
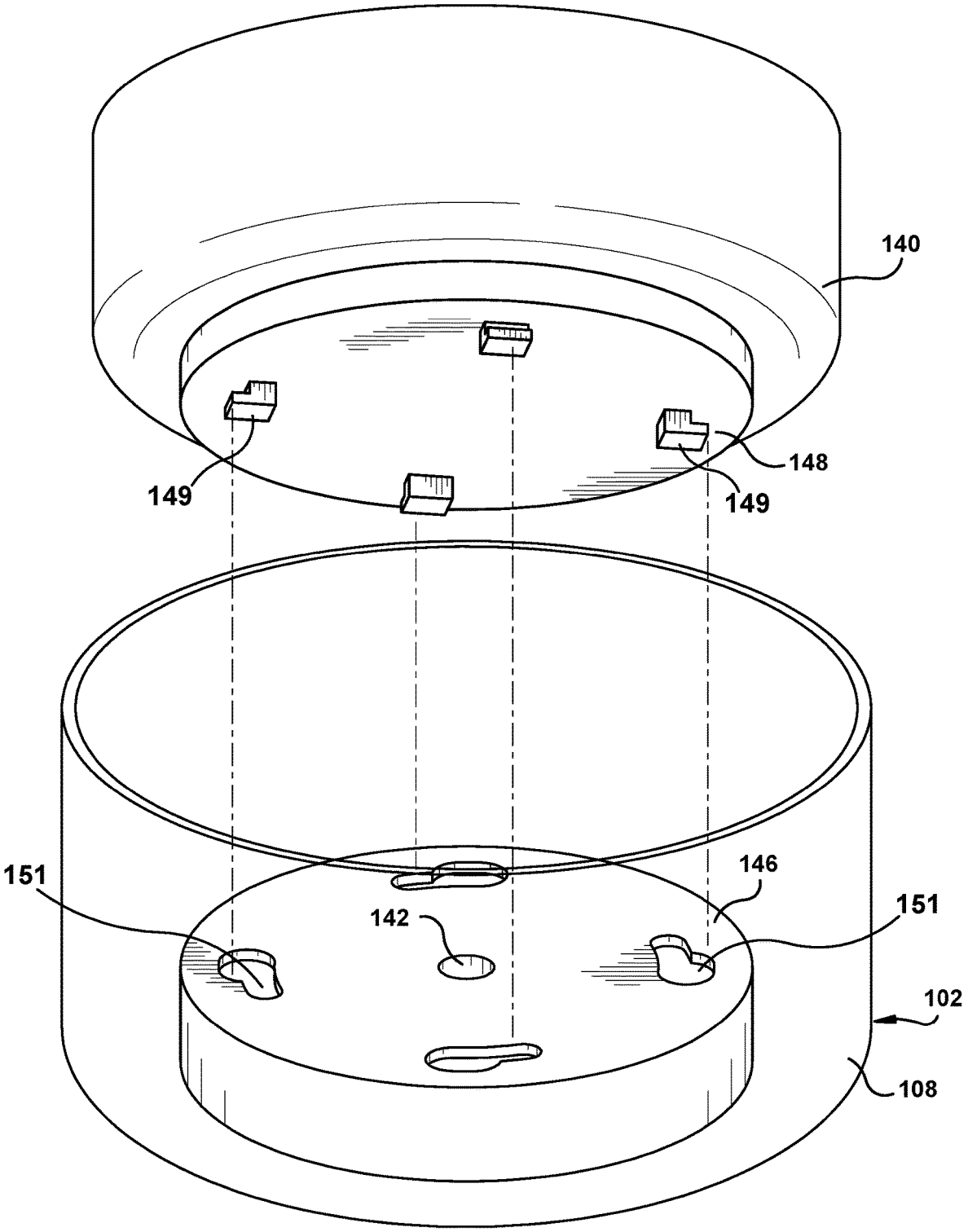
FIG. 4 shows a perspective view of one embodiment of a coupler for a mixing bowl and rotating actuator according to embodiments of the disclosure.

Stand 150 also includes a linear actuator system 170 configured to move sealed mixing chamber 102 (and rotating mixing bowl 140) in at least one linear direction, e.g., X and/or Y (FIG. 4). Referring to the top view of FIG. 4, linear actuator system 170 may include a first linear actuator system 172 coupled to mixing chamber base 160 (e.g., first member 164) for moving sealed mixing chamber 102 in a first linear direction, e.g., an X direction. Linear actuator system 170 may also include a second linear actuator system 174 coupled to mixing chamber base 160 (e.g., first member 164) for moving sealed mixing chamber 102 in a second linear direction, e.g., a Y direction, different than the first linear direction (e.g., X direction). Each linear actuator system 172, 174 may include a linear actuator 180X, 180Y coupled to foundation 152 or some other fixed member, and configured to move mixing chamber base 160 in a selected one of first and second linear directions. For example, linear actuator 180X may move mixing chamber base 160 in an X direction, and linear actuator 180Y may move mixing chamber base 160 in a Y direction. Linear actuators 180X, 180Y may include any now known or later developed linear actuator device such as but not limited to: a hydraulic or pneumatic ram (shown), or a toothed bar coupled to foundation 152 with a motorized cog adjusting linear position. Each linear actuator system 172, 174 may also include a slider 182X, 182Y coupled to respective linear actuator 180X, 180Y and configured to allow movement of the respective linear actuator 180X, 180Y in the other of the first and second linear directions from the selected one of the first and second linear directions. That is, linear actuator 180X moves in a Y-direction on slider 182X to accommodate movement of sealed mixing chamber 102 in the Y-direction by linear actuator 180Y, and linear actuator 180Y moves in an X-direction on slider 182Y to accommodate movement of sealed mixing chamber 102 in the X-direction by linear actuator 180X. Sliders 182X, 182Y may include any form of mechanism to allow controlled linear movement of linear actuators 180X, 180Y. For example, sliders 182X, 182Y may include a rail upon which the linear actuators ride, a channel in which rollers or wheels on linear actuators ride, etc. The amount of linear movement may be used defined. In one embodiment, each linear actuator 180X, 180Y may have a stroke of between 2.5 millimeters (mm) and 12.5 mm. Elastic mounts 162 may be configured to absorb whatever linear motion is provided by linear actuator system 170. While two linear actuator systems 172, 174 are shown, it is emphasized that according to embodiments, only one need be provided. Where two linear actuator systems 172, 174 are provided, only one need be used.

Mixer 100 may be employed to mix a ceramic suspension using a method of mixing according to embodiments of the disclosure. The method may include adding at least two constituents of the ceramic suspension into the mixing chamber, i.e., bowl 140. At this stage, mixing chamber 102 may be unsealed. As shown in FIG. 1, the mixing chamber may be tilted or angled (β) relative to horizontal. The mixing chamber may then be sealed by coupling lid 112 to chamber body 108, and applying a vacuum to the mixing chamber to created sealed mixing chamber 102, i.e., using vacuum source 128 (FIGS. 2 and 4). In another embodiment, mixing chamber 102 may be first sealed and then constituent(s) added via port 130.

Constituents may be mixed in sealed mixing chamber 102 with reduced cooling by simultaneously: rotating mixing head 126 relative to rotating mixing bowl 140 in sealed mixing chamber 102 with rotational actuator 134, rotating the rotating mixing bowl 140 with rotational actuator 142, and moving sealed mixing chamber 102 (and rotating mixing bowl 140) in at least one linear direction (X and/or Y (FIG. 4)). As the mixing occurs, sealed mixing chamber 102 and rotating mixing bowl 140 are tilted at angle β. In one embodiment, the moving includes moving sealed mixing chamber 102 in one linear direction X or Y, and in another embodiment, the moving may include moving sealed mixing chamber 102 in a pair of linear directions X and Y. Rotation of rotating mixing head 126 and rotating mixing bowl 140 may be in opposite directions. Sealed mixing chamber 102 may move in a limited fashion relative to foundation 152 via elastic mounts 162. For example, as shown in FIG. 1, elastic mounts 162 may allow for a limited angling Θ of sealed mixing chamber 102 relative to vertical. If an additional constituent is required, the mixing may be paused and the constituent added via port 130 (FIG. 2) to sealed mixing chamber 102, i.e., mixing bowl 140, while maintaining the vacuum. During the mixing, very little if any cooling may be necessary. Once mixing is completed, the ceramic suspension may be used to form a ceramic component, perhaps without ever cooling the ceramic suspension. The ceramic suspension may be used to form a ceramic component in any now known or later developed fashion, e.g., pouring into a mold, pouring over a frame, spraying onto a support structure, etc.

Mixer 100 provides technical effect by introducing a mixing technology that creates significantly less heat to the process of mixing ceramic suspensions. With the reduction of heat, it is possible to process larger batches of ceramic suspension immediately, rather than having long cooling steps. Mixer 100 also provides a significant reduction in labor as the material can be processed immediately rather than using a number of mixers that requires long periods of chilling between uses due to temperature constraints. The stand described herein incorporates provides at least four motions which significantly improves mixing quality and reduces mixing time. All of the operational parameters of mixer 100 can be adjusted in a controlled manner, e.g., rotational speeds, linear motion, tilt angle, etc., to accommodate different materials. In addition, the depth of the mixing bowl and/or sealed mixing chamber 102 can also be selected to maximize mixing efficiency.

It should be noted that in some alternative implementations, the steps noted herein may occur out of the order noted or, for example, may in fact be executed substantially concurrently or in the reverse order, depending upon the act involved.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A mixer, comprising:

a sealed mixing chamber having an interior;

a rotating mixing bowl within the interior of the sealed mixing chamber;

a stand for operatively supporting the sealed mixing chamber, the stand including:

a foundation, a mixing chamber base movably coupled to the foundation and positioning the sealed mixing chamber at an angle relative to horizontal, and a linear actuator system configured to move the mixing chamber base relative to the foundation in at least one linear direction;

a first port for sealingly positioning a shaft of a rotating mixing head relative to the sealed mixing chamber;

a second port in a lid of the mixing chamber for sealingly coupling a vacuum source to the interior of the sealed mixing chamber and the vacuum source coupled to the second port, wherein the vacuum source is one of a pump or compressor;

a third port in the lid of the mixing chamber for selectively allowing addition of a constituent for mixing in the rotating mixing bowl; and the rotating mixing head operatively positioned and sealingly disposed within the sealed mixing chamber, the rotating mixing head rotating within the rotating mixing bowl.

2. The mixer of claim 1, wherein the linear actuator system includes:

a first linear actuator system coupled to the mixing chamber base for moving the sealed mixing chamber in a first linear direction; and a second linear actuator system coupled to the mixing chamber base for moving the sealed mixing chamber in a second linear direction different than the first linear direction.

3. The mixer of claim 2, wherein each linear actuator system includes:

a linear actuator coupled to the mixing chamber base and configured to move the mixing chamber base in a selected one of the first and second linear directions; and a slider coupled to the respective linear actuator and configured to allow movement of respective linear actuator in the other of the first and second linear direction from the selected one of the first and second linear directions.

4. The mixer of claim 3, wherein each linear actuator has a stroke of between 2.5 millimeters (mm) and 12.5 mm.

5. The mixer of claim 1, wherein the mixing chamber base is movably coupled to the foundation by a plurality of elastic mounts.

6. The mixer of claim 1, wherein the rotating mixing head includes:

a set of beaters;

the shaft coupled to the set of beaters and configured to sealingly extend from the interior of the sealed mixing chamber to an exterior of the sealed mixing chamber; and a rotational actuator positioned in the exterior of the sealed mixing chamber for rotating the shaft and the set of beaters.

7. The mixer of claim 6, wherein the shaft includes an articulated joint allowing angled rotational coupling in a length thereof.

8. The mixer of claim 1, wherein the rotating mixing head and the rotating mixing bowl rotate in opposite directions.

9. The mixer of claim 1, wherein the rotating mixing head includes a first rotational actuator positioned in an exterior of the sealed mixing chamber, and the rotating mixing bowl includes a second rotational actuator positioned in the exterior of the sealed mixing chamber.

10. A mixer for mixing a ceramic suspension with reduced cooling to the ceramic suspension, the mixer comprising:

a sealed mixing chamber having an interior and an exterior;

a rotating mixing bowl within the interior of the sealed mixing chamber, the rotating mixing bowl including a first rotational actuator;

a first port for sealingly positioning a shaft of a rotating mixing head relative to the sealed mixing chamber;

a second port in a lid of the mixing chamber for sealingly coupling a vacuum source to the interior of the sealed mixing chamber and the vacuum source coupled to the second port, wherein the vacuum source is one of a pump or compressor;

a third port in the lid of the mixing chamber for selectively allowing addition of a constituent for mixing in the rotating mixing bowl;

a stand for operatively supporting the sealed mixing chamber, the stand including:

a foundation, a mixing chamber base movably coupled to the foundation by a plurality of elastic mounts, the mixing chamber base positioning the sealed mixing chamber at an angle relative to horizontal, and a linear actuator system to move the mixing chamber base relative to the foundation, the linear actuator system including:

a first linear actuator system coupled to the mixing chamber base for moving the sealed mixing chamber in a first linear direction; and a second linear actuator system coupled to the mixing chamber base for moving the sealed mixing chamber in a second linear direction different than the first linear direction; and the rotating mixing head operatively positioned and sealingly disposed within the sealed mixing chamber, the rotating mixing head including a second rotational actuator for rotating the rotating mixing head within the rotating mixing bowl, wherein the rotating mixing head includes:

a set of beaters;

the shaft coupled to the set of beaters and configured to sealingly extend from the interior of the sealed mixing chamber to an exterior of the sealed mixing chamber; and a rotational actuator positioned in the exterior of the sealed mixing chamber for rotating the shaft and the set of beaters, wherein the shaft includes an articulated joint allowing angled rotational coupling in a length thereof.

11. The mixer of claim 10, wherein each linear actuator system includes:

a linear actuator coupled to the mixing chamber base and configured to move the mixing chamber base in a selected one of the first and second linear directions; and a slider coupled to the respective linear actuator and configured to allow movement of respective linear actuator in the other of the first and second linear direction from the selected one of the first and second linear directions.

12. The mixer of claim 10, wherein the rotating mixing head and the rotating mixing bowl rotate in opposite directions.

* * * * *